United States Patent [19]

Cabell

[11] 4,043,594

[45] Aug. 23, 1977

[54] ADJUSTABLE CHAIR REST MEMBER

[75] Inventor: Douglas N. Cabell, Bloomfield Hills, Mich.

[73] Assignee: GF Business Equipment, Inc., Youngstown, Ohio

[21] Appl. No.: 666,208

[22] Filed: Mar. 12, 1976

[51] Int. Cl.[2] ..... A47C 1/00

[52] U.S. Cl. ..... 297/353; 297/361

[58] Field of Search ..... 297/353, 354, 361, 408, 297/410, 391, 284, 296; 248/118, 371, 393

[56] References Cited

U.S. PATENT DOCUMENTS

| | | | |
|---|---|---|---|
| 1,437,875 | 12/1922 | Travers | 297/353 X |
| 1,984,549 | 12/1934 | Rowland | 297/361 X |
| 2,139,205 | 12/1938 | Powell | 297/361 X |
| 2,547,455 | 4/1951 | Freeman | 297/353 X |
| 2,563,951 | 8/1951 | Mondy | 297/354 X |
| 3,106,423 | 10/1963 | Schwarz | 297/284 |
| 3,526,430 | 9/1970 | Eldon | 297/353 |

*Primary Examiner*—Roy D. Frazier
*Assistant Examiner*—William E. Lyddane
*Attorney, Agent, or Firm*—Emory L. Groff, Jr.

[57] ABSTRACT

A chair rest member carried by the upper reach of a vertically extending back plate includes means providing for both vertical and angular displacement of the rest member relative the back plate. A screw carried by the back plate engages a captive nut disposed within a vertical slot within the frame of the rest member to allow vertical adjustment therebetween while angular or tilt adustment is achieved by means of a screw wheel carried by the lower portion of the rest member enaging the juxtaposed face of the back plate and which, when actuated, tilts the rest member about a bearing surface above the captive nut. A curved washer attached to the captive nut permits retightening of the captive nut screw to fixedly retain the rest member in its alternate positions.

10 Claims, 7 Drawing Figures

ADJUSTABLE CHAIR REST MEMBER

This invention relates generally to furniture articles, and more particularly, to a chair provided with an improved adjustable support or rest member.

In the case of office furniture, especially secretarial chairs, it is desirable to provide a back rest member which may be vertically adjusted in a ready manner in order to accommodate the specific physical configuation of individual users. A chair back rest is intended to provide support to a user's back in the area between the shoulder blades and waist and even two users of identical physical stature may prefer a different vertical elevation of the same chair back rest to satisfy their particular desire. Additionally, it is desirable to provide means permitting of the alteration of the inclination or vertical angle of the back rest, which angular adjustment is preferably entirely independent of the vertical adjustment.

Accordingly, by the present invention, an improved chair rest member is provided having unique means permitting of ready vertical adjustment thereof with respect to the balance of the chair article, as well as separate, independent means for regulating the angular disposition of the rest member about a horizontal axis and wherein the aforesaid angular adjustment takes place along a horizontal axis passing through the means permitting of the vertical adjustment. By the manipulation of a simple tool, the back rest is released from its fixed attachment to its upright supporting means to allow manual raising or lowering thereof to the desired elevation, while angular adjustment of the back rest is achieved at any time by the manual adjustment of a thumb wheel which is concealed from veiw and is carried by the chair back rest and cooperates with the upright support means to provide the angular displacment therebetween.

Accordingly, one of the primary objects of the present invention is to provide an improved adjustable chair rest member mounted upon a relatively fixed upright support by means of an adjustment assembly permitting of relative vertical displacement therebetween and further including tilt adjustment means carried by the lower portion of the rest member and engaging the upright support means to provide angular displacement therebetween.

A further object of this invention is to provide an improved adjustable chair member including a back rest having a rearwardly facing channel disposed below an upper enclosed pocket for the reception of the upper end of a vertical upright support member and said channel includes a vertical slot including releasable means connecting the backrest to the upright support to provide vertical displacment therebetween.

Another object of the present invention is to provide an improved adjustable chair member including a back rest having a captive nut disposed within a vertical slot for attachment to an upright support member by means of a releasable screw and said captive nut is provided with an attached curved washer to allow angular displacement between the back rest and upright support member.

Still another object of the present invention is to provide an improved adjustable chair member including a back rest attached to an upright support by means permitting of the vertical adjustment therebetween and further including means permitting of angular adjustment of the back rest, which latter means includes a screw-mounted thumb wheel carried by the lower portion of the back rest and bearing upon the face of the upright support.

With these and other objects in view which will more readily appear as the nature of the invention is better understood, the present invention consists in the novel construction, combination and arrangement of parts hereinafter more fully described, illustrated and claimed.

A preferred and practical embodiment of the invention is shown in the accompanying drawings in which.

Similar reference characters designate corresponding parts throughout the several figures of the drawings.

Figure 1:
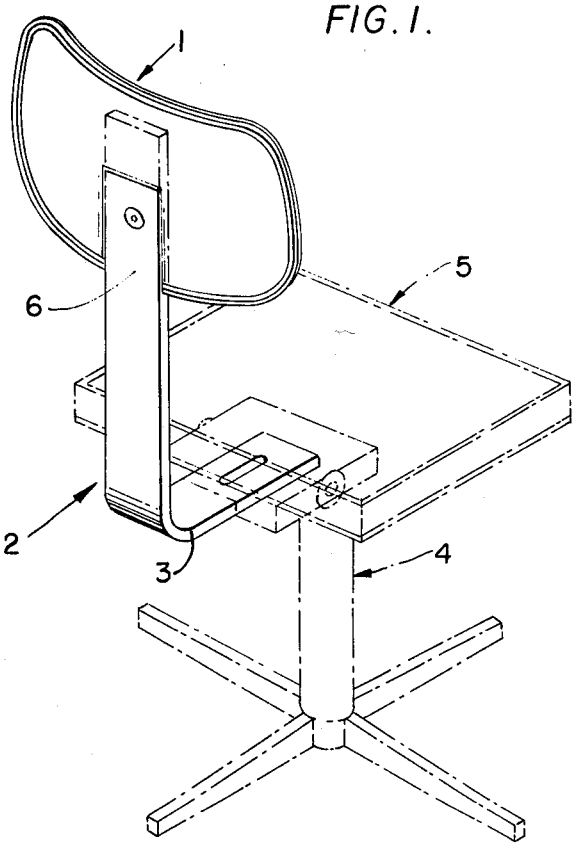
FIG. 1 is a top perspective view illustrating the adjustable chair member of the present invention.

Referring now to the drawings, particularly FIG. 1, the present invention will be understood to comprise an adjustable chair member such as the back rest, generally designated 1, and which is illustrated in the drawings in combination with an office swivel chair of the secretarial type. As will be readily appreciated, following consideration of the structure as described hereinafter, the novel construction of the rest member 1 may be employed in numerous other types of furniture devices, such as a head rest for a barber's or dentist's chair, wherein similar structure may be used to provide for vertical and angular adjustment of a rest member.

Regardless of the specific type of chair device being considered, the rest member 1 is intended to be mounted upon the upper portion of a suitable upright support such as the back plate 2 which preferably comprises a rigid metallic member having a rectangular cross section with its lower end 3 attached by any suitable means to an appropriate base structure or undercarriage 4, which base structure may also serve to provide support for an appropriate seat 5. Although well known mechanisms may be included in the base structure 4 to permit forward/rearward and/or angular adjustment of the back plate 2 as indicated by the broken lines **2*a* of FIG. 2 of the drawings, such additional structure forms no part of the present invention, which relates solely to the rest member 1 and adjustment means carried thereby for vertical and angular displacement of the rest member with respect to the relatively fixed upper portion 6 of the back plate 2**.

For economical reasons as well as for ease of fabrication, the rest member 1 is preferably constructed of suitable thermosetting material such as synthetic resin and comprises a back frame, generally designated 7, comprising a rear pan 8 from which extend a plurality of forwardly projecting outer ribs 9—9 as well as a pair of laterally spaced apart and forwardly projecting inner ribs 10—10. Spanning the two inner ribs 10—10 in the medial portion of the back frame, is a central planar web 11 which will be seen to be recessed inwardly from the outer surface 8*a* of the rear pan 8 so as to provide a vertically disposed rear channel 12 extending throughout the lower half of the height of the rest member 1 as shown most clearly in the sectional view of FIG. 2 of the drawings. Overlying the forward edges of both the outer ribs 9 and inner ribs 10 as well as the peripheral edge 7′ of the back frame 7 is a front pan 13 which is secured to the back frame 7 by means of the releasable fasteners 14—14 which preferably pass through the outer surface 13*a* of the front pan and thence through the lateral portions of the back frame central web 11 as shown in FIG. 3 of the drawings. The fasteners 14—14 are disposed through the central web 11 as close to the two inner ribs 10—10 as possible so as to provide maximum clearance in the intermediate portion of the central web for reasons which will become clear hereinafter.

Both the back frame 7 and front pan 13 may be appropriately contoured and likewise any suitable upholstery 15 may be applied over the front pan prior to its attachment to the back frame 7.

Figure 2:
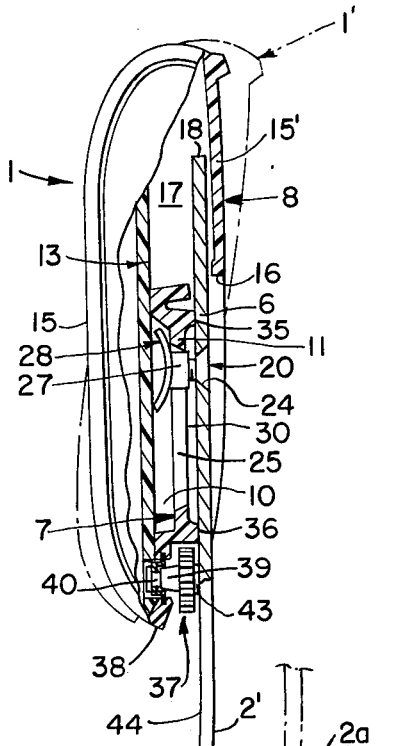
FIG. 2 is an enlarged side elevation, partly broken away, of the adjustable chair member of FIG. 1.
Figure 3:
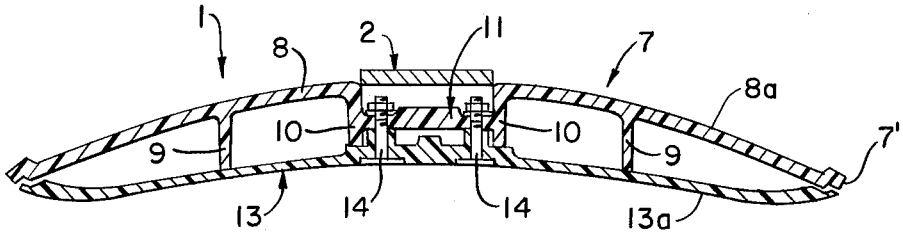
FIG. 3 is a horizontal sectional view taken along the line 3—3 of FIG. 6.
Figure 4:
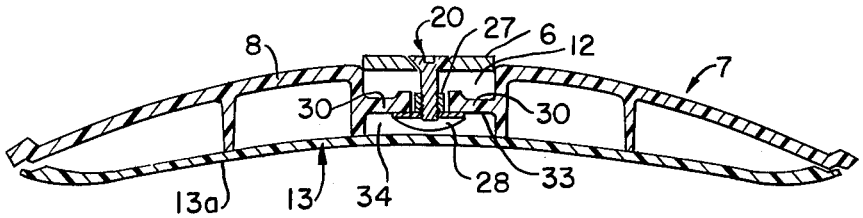
FIG. 4 is a horizontal sectional view taken along the line 4—4 of FIG. 6.

As will be seen most clearly in FIG. 2 of the drawings, the back frame 7 includes a rear upper section 15′ medially terminating in a bottom edge 16 at a level defining the upper limit of the rear channel 12. This bottom edge 16 is also disposed well rearwardly of the central web 11 to thereby provide an opening leading to the pocket 17 formed within the interior of the rest member 1 in the top portion thereof between the upper section 15′ and front pan 13. When attaching the rest member 1 to the back plate 2 the upper portion 6 thereof is disposed within the rear channel 12 with its top edge 18 located within the referenced pocket 17 and it will be noted that throughout the entire range of vertical and angular adjustment of the back rest 1, this back plate top edge 18 will at all times be disposed within the pocket 17 and thus mask it from view.

Figure 7:
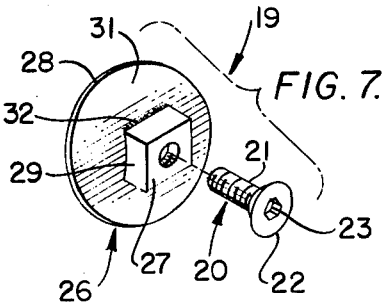
FIG. 7 is an enlarged exploded perspective view of the nut adjustment assembly of the present invention.
Figure 7:
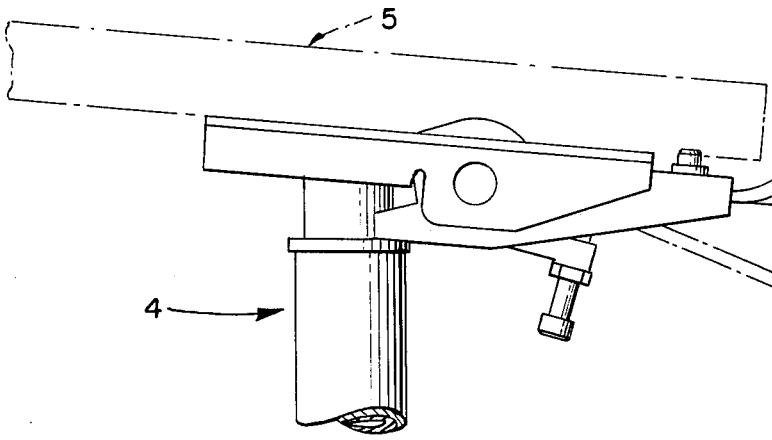

The mechanism for attaching the rest member 1 to the back plate 2 and for also allowing of vertical adjustment therebetween comprises the nut bracket adjustment assembly generally designated 19 and which is most clearly illustrated in FIG. 7 of the drawings. This adjustment assembly will be seen to comprise releasable fastener means in the form of a screw 20 having a threaded shank 21 and a conical head 22 provided with a suitable tool socket 23. Although a hexagonal socket 23 is shown in the drawings it will be appreciated that alternative means such as a conventional screwdriver slot or Phillips socket may be provided. A single chamfered hole 24 provided through the upper portion 6 of the back plate 2 allows insertion of the screw 20 from the rear surface 2′ of the back plate while the length of the screw shank 21 is sufficient to pass through a vertical slot 25 formed in the medial portion of the central web 11 of the back frame 7. The mating component of the nut bracket adjustment assembly 19 comprises a nut-washer component 26 including a rectangular nut 27 providing mating fastener means cooperating with the screw 20 and a relatively fixed curved washer 28. The nut 27 is adapted to remain within the central web vertcal slot 25 and accordingly it will be understood that the horizontal width as defined by the distance between the two side walls 29—29 of the nut is selected to provide a close sliding fit within the lateral limits of the vertical slot 25 as defined by the two medial web sections 30—30 of the central web 11. The washer 28 includes a rear convex face 31 which is preferably fabricated to provide a constant radius when viewed as in FIG. 2 of the drawings and this washer will be understood to be permanently affixed to the rectangular nut 27 by any suitable means such as the weld line 32, it being obvious that a weld line should be avoided between the side walls 29 of the nut and the curved washer in order to preclude interference in this area with the front surfaces 33 of the medial web sections 30 during the adjustment operations of the rest member 1.

With the foregoing structure in mind it will therefore follow that the nut washer component 26 is initially installed from the front of the central web 11 and accordingly a front channel 34 is provided by the central web 11 and two inner ribs 10—10 to accommodate the curved washer 28 and its displacement during subsequent adjustments of the rest member 1.

With the above structure in mind the operation of the present invention during vertical adjustment of the rest member 1 may now be described. The rest member 1 is shown in its lowermost position of vertical adjustment in FIG. 2 of the drawings wherein it will be observed that the nut 27 is positioned adjacent the uppermost portion of the vertical slot 25. The rest member is securely retained in this position by the tightening of the screw 20, which action will be understood to draw the nut-washer component 26 rearwardly as the conical head 23 of the screw is drawn forwardly. This tightening force applied to the nut 27 is transmitted to the curved washer 28 and more particularly to its rear convex face 31, and in view of the curvature of this face 31 it will follow that positive point contact is made therebetween on opposite sides of the nut 27 against each of the medial web sections 30—30 with the result that the rest member 1 is securely affixed relative the upper portion 6 of the back plate 2.

The clamping action as derived upon tightening of the nut bracket adjustment assembly 19 is transmitted from the back frame 7 to the back plate 2 through at least the upper bearing surface 35 and after additionally through the lower bearing surface 36 as provided by rearward projections formed above and below the central web vertical slot 25, respectively. Each surface 35 and 36 comprises a planar line of contact and thus when tightly engaging the back plate, precludes unwanted tilting of the back rest about a vertical axis. As will be apparent hereinafter, the upper bearing surface 35 always engages the back plate when the assembly 19 is tightened while the lower bearing surface 36 will only abut the back plate when the back rest is tilted forward to its maximum extent. By this arrangement of two substantially spaced apart bearing surfaces between the rest member and back plate, with the clamping means disposed therebetween, it will follow that a positive locking action may be achieved between the two components without any unwanted forward or rearward tilting of the rest member, and only a slight manipulation of the screw 20 by the appropriate tool is necessary to release the clamping force of the nut washer component 26 in order to permit subsequent vertical adjustment of the rest member 1, which adjustment is smooth and quiet, particularly when the structure of the back frame 7 is of a synthetic resinous material.

Figure 5:
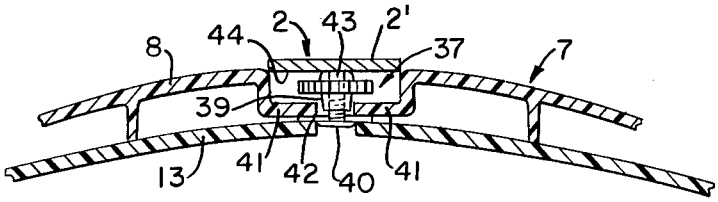
FIG. 5 is a fragmentary horizontal sectional view taken along the line 5—5 of FIG. 6.
Figure 6:
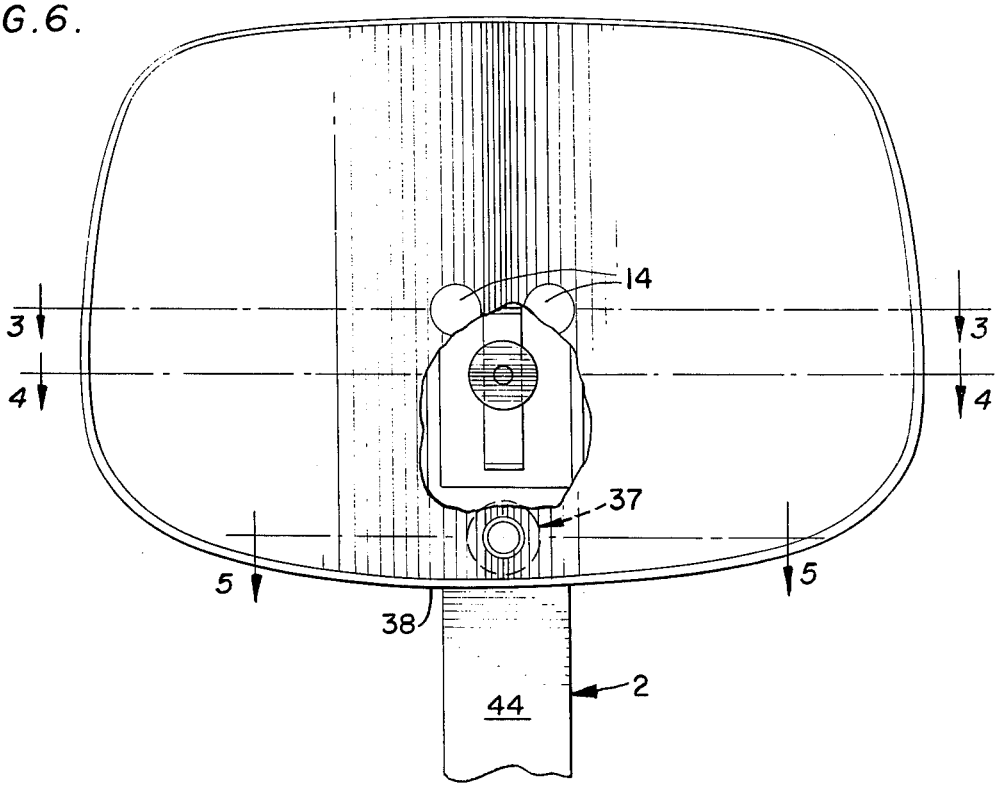
FIG. 6 is a front elevation view, partly broken away, of the adjustable chair member of FIG. 1.

Entirely separate axially adjustable screw means are provided to permit angular or tilt adjustment of the back rest 1 relative the back plate 2 about a horizontal axis. This means comprises a tilt adjusting wheel generally designated 37 carried by the rest member adjacent its bottom edge 38. The adjusting wheel 37 includes a threaded hub 39 engageable with a fixed screw or stud 40 projecting from a forwardly offset web 41 formed on the lower portion of the back frame 7 as shown most clearly in FIG. 5 of the drawings. An appropriate mounting plate 42 secures the stud 40 relative the rest member 1 such that subsequent rotation of the adjusting wheel 37 upon the stud 40 will move the adjusting wheel and its hub in one axial direction or the other relative the stud 40 and rest member 1. Projecting rearwardly of the adjusting wheel hub 39 is a rounded nose 43, which nose at all times will be understood to be juxtaposed the face 44 of the back plate 2. With the foregoing structure in mind it will thus follow that the rounded nose 43 of the adjusting wheel 37 comprises an adjustable extension of the lower portion of the rest member 1 and accordingly axial displacement thereof will either tend to urge the lower portion 38 of the rest member forwardly and away from the back plate 2, or on the other hand, allow the bottom edge 38 of the rest member to move rearwardly and toward the back plate 2 such that the angular disposition or tilt adjustment of the back rest 1 may be selectively altered.

Turning to FIG. 2 of the drawings, it will be observed that the rest member 1 is illustrated in full lines as it would appear when disposed in the full forward tilt position inasmuch as both the upper bearing surface 35 and lower bearing surface 36 of the back frame 7 are engaging the face 44 of the back plate 2. When it is desired to modify the tilt adjustment of the rest member 1 to a rearwardly inclined position as illustrated by the broken line portions 1' of the back rest 1 of FIG. 2, it is necessary to initially loosen the screw 20 thereby increasing the amount of threaded shank 21 of the screw that is exposed between the screwhead 22 and nut 27. Following this action it will be seen that the upper and lower bearing surfaces 35 and 36 are no longer biased toward the back plate 2 and likewise a prior clamping action of the washer convex surface 31 against the web sections 30—30 is relieved. Thereafter, while holding the rest member 1 with one hand, its top may be precisely tilted rearwardly by manually rotating the wheel 37 so as to displace the hub 39 and its nose 43 rearwardly against the back plate 2 so as to move the lower bearing surface 36 away from the back plate. Subsequent tightening of the screw 20 ensures firm engagement between the upper bearing surface 35 and back plate 2 and this, coupled with the resultant biasing of the wheel nose 43 against the plate 2, will be understood to provide a secure anchoring of the adjusted rest member. Although separate means have been described for achieving the vertical and tilt adjustments of the instant rest member 1, it will now be readily appreciated that the unique construction of the nut bracket adjustment assembly 19 plays an important part in allowing and retaining the described tilt adjustment by means of the adjusting wheel 37 inasmuch as actuation of the screw 20 allows loosening of the clamping action of the curved washer 28 against the rest member medial web sections 30—30 whereby subsequent turning of the adjusting wheel 37 tilts the rest member about a horizontal axis passing through the upper bearing surface 35 disposed above the nut bracket adjustment assembly 19. Following any such adjustment the screw 20 is re-tightened to retain the tilt position while a different portion of the washer convex surface 31 engages and is clamped against the rest member 1.

I claim:

1. A chair including an upright back plate having an upper portion provided with a face and rear surface and a top edge, a rest member attached to said back plate upper portion and provided with means permitting both vertical and angular adjustment of said rest member relative said back plate upper portion, said rest member including a back frame provided with a central web including front and rear surfaces, said web having a vertical slot therethrough adapted to overlie said face of said back plate upper portion, said vertical adjustment means including a nut bracket adjustment assembly joining said back plate upper portion to said rest member central web, said nut bracket assembly provided with releasable fastener means carried by said back plate upper portion and projecting toward said web rear surface, mating fastener means disposed within said web slot and engaging said releasable fastener means, said mating fastener means including a pivotal member having a rear surface in overlying engagement with said web front surface, said pivotal member rear surface defining a convex surface when viewed in side elevation, said angular adjustment means including axially adjustable screw means carried by said rest member below said web slot and projecting rearwardly toward said back plate face to engage same, whereby vertical adjustment of said back rest is achieved by loosening said releasable fastening means to allow raising or lowering of said back rest as said mating fastener means is moved relative said web slot, and angular adjustment of said back rest is achieved by manipulating said screw means to axially displace same and cause tilting of said back rest about a horizontal axis passing through said back rest at a point above said mating fastener means.

2. A chair according to claim 1 wherein, said back plate upper portion is provided with a hole, said releasable fastener means comprising a screw disposed through said hole and said mating fastener means disposed within said web slot includes an element provided with a pair of vertical parallel side walls providing a close sliding fit within said web slot while precluding angular displacement of said element as said screw is manipulated.

3. A chair according to claim 2 wherein, said element having a pair of parallel side walls comprises a threaded nut.

4. A chair according to claim 1 wherein, said axially adjustable screw means includes a threaded stud affixed to said back frame and an adjusting wheel threaded upon said stud and having a rear nose engageable with said back plate face.

5. A chair according to claim 1 wherein, said pivotal member comprises a curved washer.

6. A chair according to claim 5 wherein, the curvature of said washer is defined by a substantially constant radius.

7. A chair according to claim 1, wherein, said rest member back frame includes a rear pan having an outer surface, a pair of vertical ribs projecting forwardly from said rear pan, and said central web is disposed between said ribs and recessed from said pan outer surface to provide a rear channel for the reception of said back plate upper portion.

8. A chair according to claim 7 wherein, said recessed central web is disposed in the lower portion of said rear pan, said rear pan including an upper section having a bottom edge disposed adjacent the upper limit of said web rearwardly offset therefrom, said back frame provided with an interior pocket bounded by said rear pan upper section and said back plate top edge is disposed within said pocket.

9. A chair according to claim 7 including, a front pan overlying said ribs and defining a front channel with said web front surface, and said mating fastener pivotal member is disposed within said front channel.

10. A chair according to claim 7 including, upper and lower bearing surfaces projecting rearwardly from said central web above and below said slot, respectively, and adapted to engage said back plate face.

* * * * *